United States Patent [19]

Blackwood et al.

[11] Patent Number: 4,646,540

[45] Date of Patent: Mar. 3, 1987

[54] COOLING SECTION FOR CONTINUOUS WEB MATERIAL IMPREGNATED WITH HOT LIQUID

[75] Inventors: Albert J. Blackwood, Perrysburg; Thomas R. Brady, Granville, both of Ohio

[73] Assignee: Owens-Corning Fiberglas Corporation, Toledo, Ohio

[21] Appl. No.: 800,934

[22] Filed: Nov. 22, 1985

[51] Int. Cl.[4] ..... F25D 17/02

[52] U.S. Cl. ..... 62/373; 34/119; 34/124; 162/207; 165/89

[58] Field of Search ..... 62/64, 373; 34/119, 34/124; 162/207; 165/89

[56] References Cited

U.S. PATENT DOCUMENTS

| | | | |
|---|---|---|---|
| 1,768,777 | 7/1930 | Moller | 165/89 |
| 2,435,959 | 2/1948 | Eaby | 165/89 |
| 2,599,346 | 6/1952 | Offen | 165/89 |
| 2,603,457 | 7/1952 | Bishop | 165/89 |
| 2,772,075 | 11/1956 | Mayer | 165/89 |
| 3,359,647 | 12/1967 | Webb | 165/89 |
| 3,426,839 | 2/1969 | Overton | 165/89 |
| 3,513,565 | 5/1970 | Jacobson | 165/89 |
| 4,110,092 | 8/1978 | Kunioka et al. | 62/64 |
| 4,183,149 | 1/1980 | Chance et al. | 34/124 |
| 4,184,268 | 1/1980 | Christin et al. | 34/124 |

*Primary Examiner*—Ronald C. Capossela

*Attorney, Agent, or Firm*—Ronald C. Hudgens; Ted C. Gillespie; Paul J. Rose

[57] ABSTRACT

The chill rolls of the cooling section are hollow, open-ended rolls. Spray nozzles in each roll spray water on the instantaneously upper half of the interior periphery and a fan blows air through the roll to effect evaporative cooling. Three different arrangements of the spray nozzles are disclosed for always directing spray to only the upper half of each chill roll.

14 Claims, 8 Drawing Figures

COOLING SECTION FOR CONTINUOUS WEB MATERIAL IMPREGNATED WITH HOT LIQUID

TECHNICAL FIELD

This invention relates generally to cooling sections for hot impregnated web material, and more particularly to a cooling section having improved chill rolls. The invention is particularly useful in the production of asphalt roofing membrane.

BACKGROUND ART

Some prior chill rolls include inner and outer concentric shells having cooling water circulated through the space therebetween, a hollow bearing journal and hollow spokes being provided at each end. These former chill rolls have to be taken apart periodically for cleaning away rust and scale. They are heavy, expensive in construction, expensive to operate, and inefficient in cooling.

Other prior chill rolls comprise single-wall cylindrical shells with closed ends and having cooling water circulated therethrough. Such single-wall chill rolls also are heavy, expensive to operate, and inefficient in cooling.

DISCLOSURE OF INVENTION

In accordance with the invention, a cooling section is provided wherein each of the chill rolls is a single shell. Cooling of a roll is accomplished by internal sprays of water, with accumulated excess flowing out open ends. Air blown through the rolls provides additional evaporative cooling. The chill rolls are lighter and less expensive, less water is used, and the operating power requirement is greatly reduced from that required for operating former chill rolls. Greater cooling efficiency enables product to be run through at higher speed.

BRIEF DESCRIPTION OF DRAWINGS

The invention is more fully described hereinafter, reference being taken to the accompanying drawings wherein.

BEST MODE OF CARRYING OUT THE INVENTION

Figure 1:
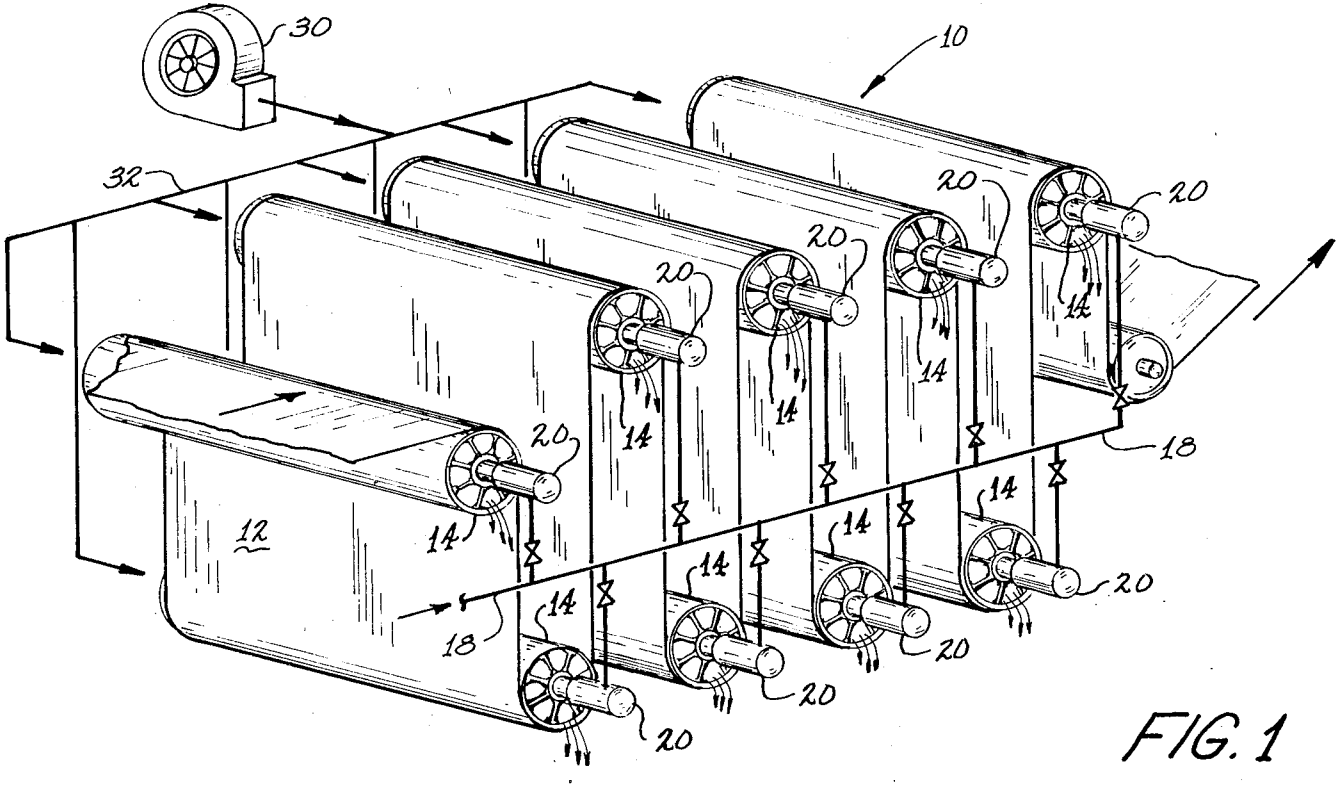
FIG. 1 is a schematic fragmentary isometric view of a cooling section constructed in accordance with the invention and forming a part of a manufacturing apparatus for impregnated material such as, for example, asphalt roofing membrane.

With reference to the drawings, FIG. 1 shows a cooling section 10 constructed in accordance with the invention and forming part of a production line for manufacturing impregnated web material 12 such as, for example, modified asphalt roofing membrane. The impregnated web material 12 includes one or more fibrous mats which are impregnated with a hot liquid, such as modified asphalt, at an impregnating station upstream of the cooling section 10.

The cooling section 10 includes a plurality of chill rolls or cooled conveyor drums 14, nine in the embodiment shown. At least some of the conveyor drums 14 are rotatably driven. For example, as viewed in FIG. 1, the four uppermost drums 14 and the first, slightly lower drum 14 may be driven clockwise by suitable motors and timing belts or chains (not shown), while the four lowermost drums 14 may idle, being turned counterclockwise by the web material 12. Each drum 14 is mounted in a suitable framework (not shown) and has a central hollow shaft 16 (FIG. 2) including a central passageway **16*a* supplied with water at one end through a respective branch conduit of a water supply system 18 (FIG. 1) and a rotary union 20. At the opposite end of each shaft 16, the passageway 16*a* is plugged with a threaded plug 22. Opposite ends of each drum 14 are essentially open, each end being supported by a hub 24 keyed to the shaft 16 and a spoked plate 26 including an inner ring portion 26*a*, spoke portions 26*b*, and an outer ring portion 26*c*. The inner ring portion 26*a* is secured to the hub 24 and the outer ring portion 26*c* is secured to the cylindrical shell or drum 14. A lip ring 28 is secured to the outer ring portion 26*c* flush with a radially inner edge thereof. The lip rings 28 convey accumulated water smoothly away from the drum 14 as indicated by the arrows at the right-hand end of each drum 14 in FIG. 1**.

A centrifugal fan 30 blows air through each of the drums 14, from left to right as viewed in FIG. 1, by way of a duct system 32 only schematically shown but having branch ducts with open ends respectively adjacent left-hand ends of the drums 14.

Figure 2:
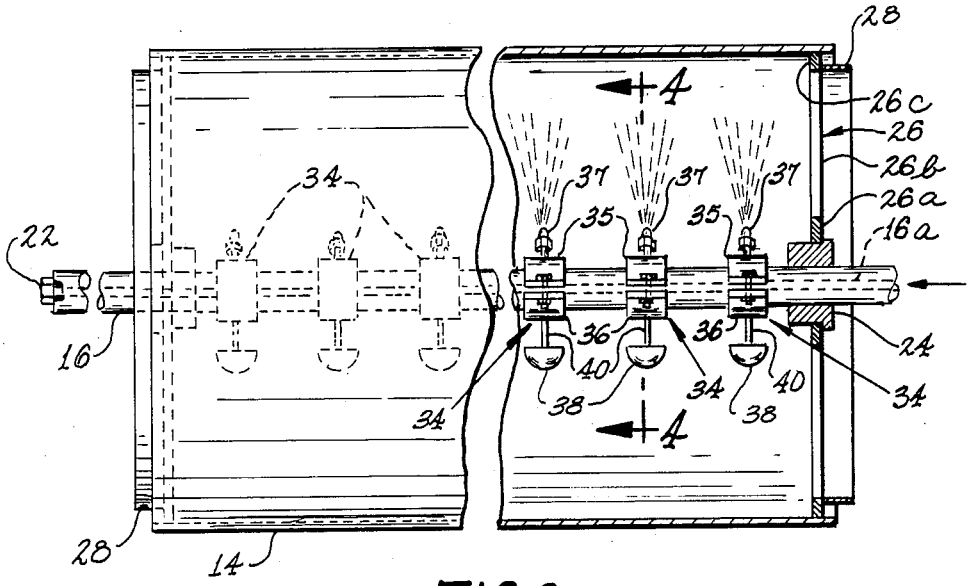
FIG. 2 is a fragmentary elevational view, partly in section, of one of the chill rolls of the cooling section of FIG. 1.
Figure 4:
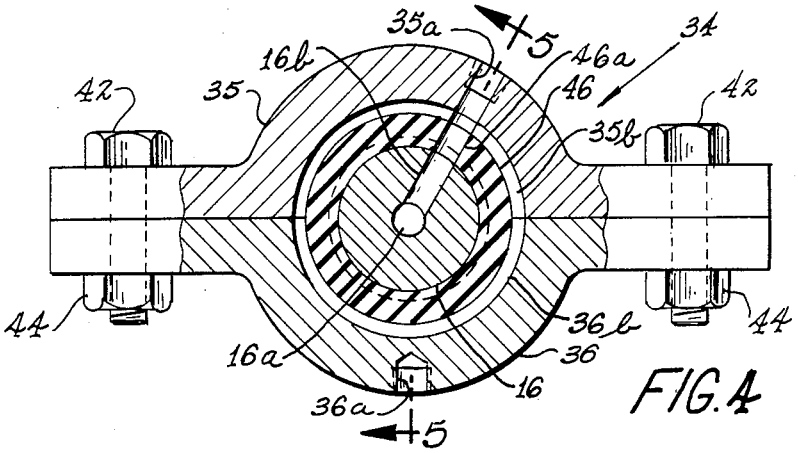
FIG. 4 is an enlarged sectional view taken generally along the line 4—4 of FIGS. 2 and 8, certain portions being omitted.
Figure 5:
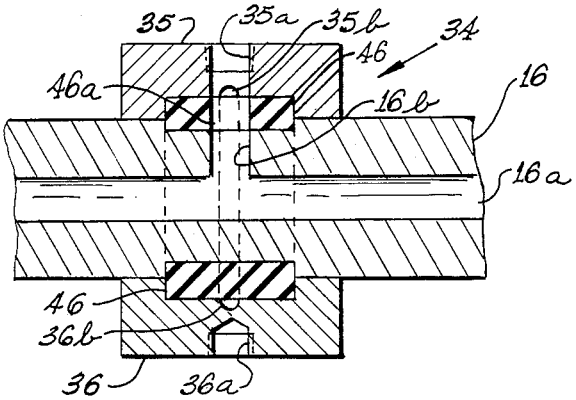
FIG. 5 is a sectional view taken generally along bent line 5—5 of FIG. 4.

As shown in FIG. 2, the shaft 16 is provided with a plurality of spray nozzle assemblies 34 each including an upper clamp 35 and a lower clamp 36. A conventional spray nozzle 37 is secured to each upper clamp 35 and a counterweight 38 on a threaded 40 is secured to each lower clamp 36. The spray nozzle 37 is threaded into a partially threaded passageway **35*a* (FIGS. 4 and 5) and the rod 40 is threaded into a threaded opening 36*a*. The clamps 35 and 36 are held loosely around the shaft 16 by a pair of bolts 42 and nuts 44**.

At each spray nozzle assembly 34, the shaft 16 and the clamps 35 and 36 are recessed (See FIG. 5) to receive an annular sealing and retaining member 46. The member 46 retains the clamps 35 and 36 in position axially of the shaft 16, but sufficient clearance (not shown) is provided between the clamp 35 and the shaft 16, between the clamp 36 and the shaft 16, between the clamp 35 and the member 46, and between the clamp 36 and the member 46 for the counterweight 38 to maintain the spray nozzle assembly 34 stationary as the shaft 16 and member 46 are rotating. This clearance reduces the effectiveness of the member 46 in sealing, but the amount of leakage therepast is minimal. Further, leakage at the outside of the member 46 serves as lubrication between the stationary and rotating parts.

At each assembly 34, the axial passageway **16*a* communicates with a radial passageway 16*b* in the shaft 16, a radial passageway 46*a* in the member 46, and an annular groove formed by grooves 35***b* and 36*b* respectively provided in the clamps 35 and 36. The passageway 35*a* communicates with the groove 35*b* and is continuously supplied with water for the nozzle 37 even when the passageways 16*b* and 46*a* rotate out of alignment therewith.

The counterweights 38 maintain the nozzles 37 in position to continuously spray an instantaneously upper portion of the respective chill roll or conveyor drum 14. Air blowing through the drum 14 provides an additional evaporative cooling effect.

Figure 3:
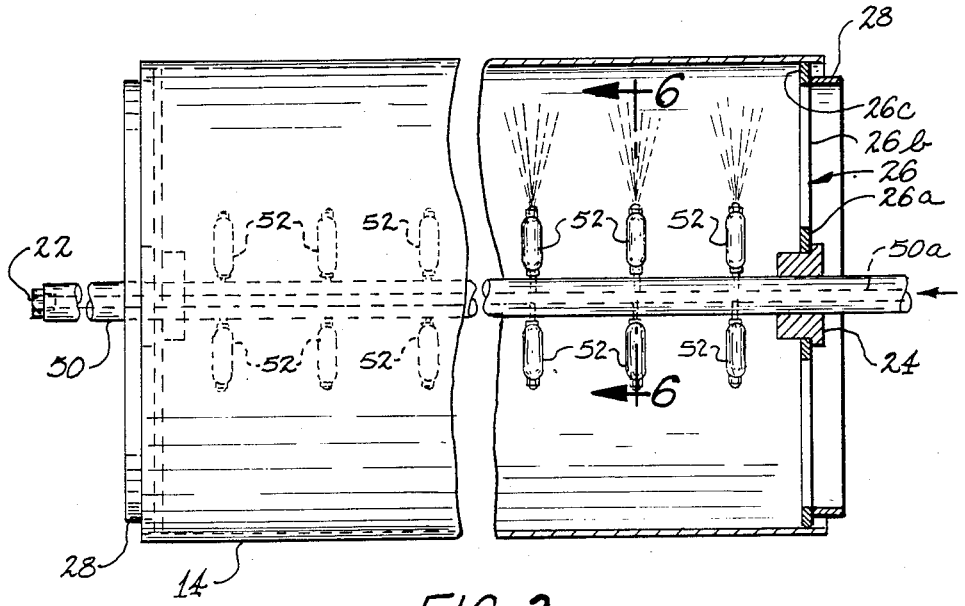
FIG. 3 is a view similar to FIG. 2, but illustrating an alternative embodiment of a chill roll.
Figure 7:
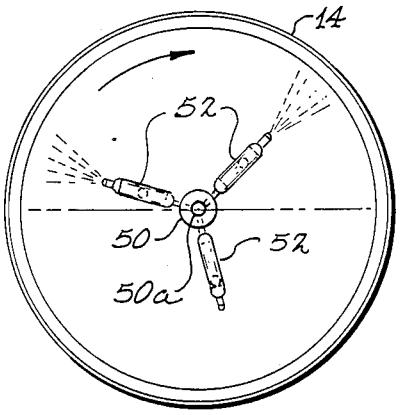
FIG. 7 is a schematic end view, with portions omitted, of the chill roll of FIG. 3.
Figure 6:
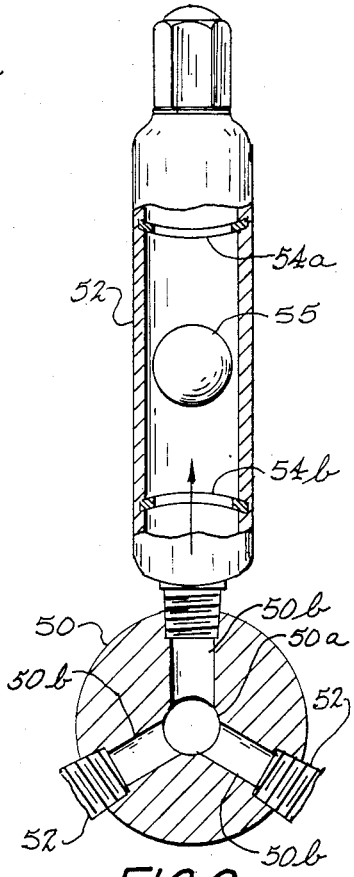
FIG. 6 is an enlarged sectional view taken generally along the line 6—6 of FIG. 3.

FIGS. 3, 6, and 7 illustrate an alternative embodiment of the invention wherein spray nozzles rotate with the shaft, but close when in the lower portion of the drum and open when in the upper portion of the drum. Thus, a hollow shaft 50 is provided with a plurality of sets of three spray nozzles 52 arcuately spaced 120° apart from each other in each set. Included in each nozzle 52 are a pair of spaced valve seats 54*a* and 54*b* and a ball check valve 55 therebetween. The shaft 50 has an axial passageway 50*a*, and at each set of nozzles 52 it is provided with three radial passageways 50*b* into which the nozzles 52 are respectively threaded. When a particular nozzle 52 is in the lower half of a drum 14, water pressure and gravity seat the ball check valve on the valve seat 54*a* and shut off flow. The flow may remain shut off as the nozzle 52 first enters the upper half of the drum 14, but eventually a point is reached where gravity overcomes water pressure and unseats the ball check valve 55 from the valve seat 54*a*, turning on the flow of water until the nozzle 52 again passes into the lower half of the drum 14. The valve seat 54*b* acts as a retainer, the ball 55 not seating thereon while the apparatus is in operation.

Figure 8:
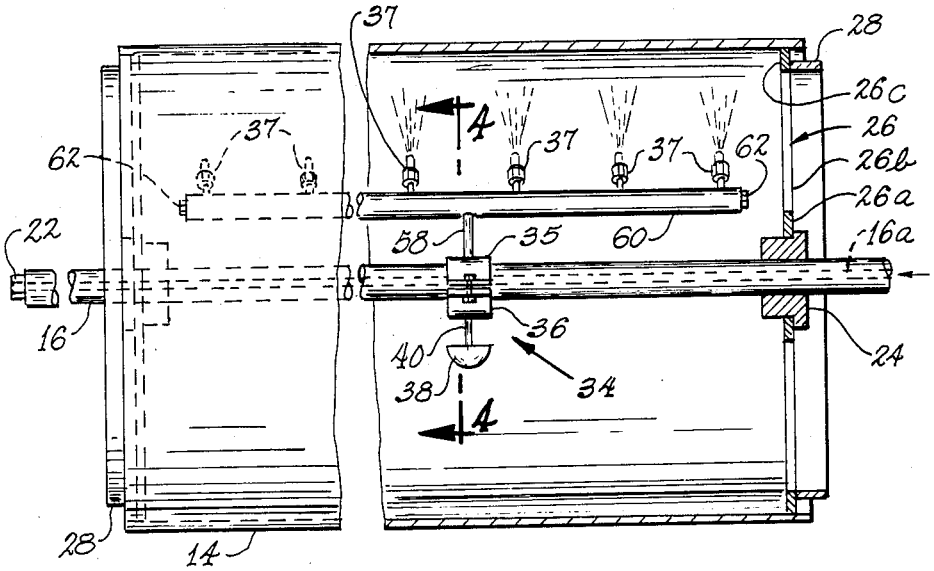
FIG. 8 is a fragmentary elevational view, partly in section, of still another embodiment of a chill roll.

FIG. 8 illustrates another embodiment of the invention representing an improvement over the embodiment of FIG. 2. In FIG. 8, the shaft 16 has only one nozzle assembly 34, but instead of one spray nozzle 37 on the upper clamp 35, a nipple 58 is connected to the passageway 35*a* (FIGS. 4 and 5) at one end and to a spray nozzle header pipe 60 at the other end. A plurality of the spray nozzles 37 are spaced along the pipe 60 and mounted in communication therewith. Opposite ends of the pipe 60 are provided respectively with plugs 62.

By spraying only the instantaneous upper half of a drum 14, greater cooling efficiency is achieved from a given amount of water. Spraying into accumulated water in the lower half of a drum has less cooling effect on the shell of the drum, because of no evaporative cooling effect.

Various modifications may be made in the structure shown and described without departing from the scope of the invention as set forth in the appended claims. With regard to the embodiment of FIGS. 2, 4, and 5, it is within the scope of the invention to form the counterweight 38 as an integral part of the lower clamp 36, and to replace the sealing and retaining member 46 with a pair of O-rings spaced respectively on opposite sides of the groove 35*b*–36*b*.

INDUSTRIAL APPLICABILITY

Spraying the interior of the open-ended chill rolls while blowing air therethrough results in greater cooling efficiency with less water, compared to former closed-end chill rolls with water circulating therethrough. Power and maintenance requirements are also reduced. The invention can be used in all asphalt roofing material factories with less capital investment required than formerly.

We claim:

1. A cooling section for continuous web material impregnated with hot liquid, the cooling section comprising a plurality of juxtaposed rotatably mounted essentially open-ended upper chill rolls, a plurality of juxtaposed rotatably mounted essentially open-ended lower chill rolls, all the chill rolls having substantially the same diametric width, the upper chill rolls being transversely spaced apart from each other in a plan view substantially by the width of one roll, the lower chill rolls being transversely spaced apart from each other in a plan view substantially by the width of one roll, the upper chill rolls being transversely offset from the lower chill rolls in a plan view substantially by the width of one roll, the web material traversing around upper portions of the upper chill rolls and around lower portions of the lower chill rolls in a series of loops, at least some of the chill rolls being rotatably driven, and the upper chill rolls rotating in an opposite direction from the direction of rotation of the lower chill rolls when the cooling section is in operation, a fan and duct work blowing air through the chill rolls when the cooling section is in operation, each of said chill rolls including a cylindrical wall, a rotatably mounted central shaft with an axial passageway, means connecting the cylindrical wall to the shaft, and a plurality of spray nozzle means mounted on the shaft in spaced relationship from each other therealong and operatively connected to the axial passageway, a plurality of rotary unions operatively connected respectively to the axial passageways of the chill roll shafts, and a water supply system having a plurality of branch conduits connected respectively to the rotary unions, the spray nozzle means of each chill roll being constructed and arranged to spray water continuously only on an instantaneously upper portion of the inner side of the cylindrical wall when the cooling section is in operation.

2. A cooling section as claimed in claim 1 wherein each spray nozzle means on the shaft of a chill roll comprises a plurality of spray nozzles fixedly secured to the shaft in arcuately spaced relationship to each other therearound, each spray nozzle having an inner chamber communicating with a radial passageway in the shaft connected to the axial passageway, a valve seat in the inner chamber, and a check valve in the inner chamber operatively associated with the valve seat to shut off flow of water through the inner chamber when the spray nozzle is in an instantaneously lower portion of the cylindrical wall but to permit flow of water under pressure when the spray nozzle is in an instantaneously upper portion of the cylindrical wall.

3. A cooling section as claimed in claim 2 wherein the check valve is a ball.

4. A cooling section as claimed in claim 1 wherein each spray nozzle means on the shaft of a chill roll comprises an upper clamp and a lower clamp secured to each other around the shaft in relatively rotatable relationship with respect thereto and each having an inner groove extending circumferentially of the shaft whereby an annular groove around the shaft is provided by the two clamps, the lower clamp being counterweighted to maintain the clamps stationary as the shaft is rotated and the upper clamp having a radial passageway communicating with the annular groove and having a spray nozzle mounted thereon in communication with the radial passageway, and wherein the shaft is provided with a radial passageway communicating with the axial passageway therein and with the annular groove.

5. A cooling section as claimed in claim 4 wherein the clamp members and the shaft are recessed to provide an annular recess therebetween and an annular sealing and retaining member is provided in the recess.

6. A cooling section as claimed in claim 1 wherein the plurality of spray nozzle means on the shaft of a chill roll comprises an upper clamp and a lower clamp secured to each other around the shaft in relatively rotatable relationship with respect thereto and each having an inner groove extending circumferentially of the shaft whereby an annular groove around the shaft is provided by the two clamps, the lower clamp being counterweighted to maintain the clamps stationary as the shaft is rotated and the upper clamp having a radial passageway communicating with the annular groove, a spray nozzle header pipe mounted parallel to the shaft and communicating with the radial passageway in the upper clamp, and a plurality of spray nozzles in communication with the header pipe and spaced from each other therealong, and wherein the shaft is provided with a radial passageway communicating with the axial passageway therein and with the annular groove.

7. A cooling section as claimed in claim 6 wherein the clamp members and the shaft are recessed to provide an annular recess therebetween and an annular sealing and retaining member is provided in the recess.

8. A chill roll comprising an essentially open-ended cylindrical wall, a rotatably mounted central shaft having an axial passageway, means connecting the cylindrical wall to the shaft, and a plurality of spray nozzle means mounted on the shaft in spaced relationship from each other therealong and operatively connected to the axial passageway, the spray nozzle means being constructed and arranged to spray water continuously only on an instantaneously upper portion of the inner side of the cylindrical wall as the cylindrical wall and central shaft are rotated and water is supplied to the axial passageway.

9. A chill roll as claimed in claim 8 wherein each spray nozzle means comprises a plurality of spray nozzles fixedly secured to the shaft in arcuately spaced relationship to each other therearound, each spray nozzle having an inner chamber communicating with a radial passageway in the shaft connected to the axial passageway, a valve seat in the inner chamber, and a check valve in the inner chamber operatively associated with the valve seat to shut off flow of water through the inner chamber when the spray nozzle is in an instanntaneously lower portion of the cylindrical wall but to permit flow of water under pressure when the spray nozzle is in an instantaneously upper portion of the cylindrical wall.

10. A chill roll as claimed in claim 9 wherein the check valve is a ball.

11. A chill roll as claimed in claim 8 wherein each spray nozzle means comprises an upper clamp and a lower clamp secured to each other around the shaft in relatively rotatable relationship with respect thereto and each having an inner groove extending circumferentially of the shaft whereby an annular groove around the shaft is provided by the two clamps, the lower clamp being counterweighted to maintain the clamps stationary as the shaft is rotated and the upper clamp having a radial passageway communicating with the annular groove and having a spray nozzle mounted thereon in communication with the radial passageway, and wherein the shaft is provided with a radial passageway communicating with the axial passageway therein and with the annular groove.

12. A chill roll as claimed in claim 11 wherein the clamp members and the shaft are recessed to provide an annular recess therebetween and an annular sealing and retaining member is provided in the recess.

13. A chill roll as claimed in claim 8 wherein the plurality of spray nozzle means comprises an upper clamp and a lower clamp secured to each other around the shaft in relatively rotatable relationship with respect thereto and each having an inner groove extending circumferentially of the shaft whereby an annular groove around the shaft is provided by the two clamps, the lower clamp being counterweighted to maintain the clamps stationary as the shaft is rotated and the upper clamp having a radial passageway communicating with the annular groove, a spray nozzle header pipe mounted parallel to the shaft and communicating with the radial passageway in the upper clamp, and a plurality of spray nozzles in communication with the header pipe and spaced from each other therealong, and wherein the shaft is provided with a radial passageway communicating with the axial passageway therein and with the annular groove.

14. A chill roll as claimed in claim 13 wherein the clamp members and the shaft are recessed to provide an annular recess therebetween and an annular sealing and retaining member is provided in the recess.

* * * * *